US009714149B2

(12) United States Patent
Gillier et al.

(10) Patent No.: US 9,714,149 B2
(45) Date of Patent: Jul. 25, 2017

(54) MEDIA DESKEW

(71) Applicant: NCR Corporation, Duluth, GA (US)

(72) Inventors: Jason M. Gillier, Waterloo (CA); Benjamin T. Widsten, Kitchener (CA); Frank B. Dunn, Waterloo (CA)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 14/927,960

(22) Filed: Oct. 30, 2015

(65) Prior Publication Data

US 2017/0121139 A1 May 4, 2017

(51) Int. Cl.
*B65H 9/16* (2006.01)

(52) U.S. Cl.
CPC ..... *B65H 9/16* (2013.01); *B65H 9/166* (2013.01); *B65H 2301/331* (2013.01); *B65H 2404/166* (2013.01)

(58) Field of Classification Search
CPC . B65H 9/04; B65H 9/16; B65H 9/163; B65H 9/166; B65H 2404/166; B65H 9/002
See application file for complete search history.

(56) References Cited

U.S. PATENT DOCUMENTS

| | | | | |
|---|---|---|---|---|
| 5,725,211 | A * | 3/1998 | Blanchard | B65H 9/00 271/265.01 |
| 6,273,418 | B1 * | 8/2001 | Fujikura | B65H 9/103 271/227 |
| 8,328,188 | B2 * | 12/2012 | Mandel | B65H 9/002 271/228 |
| 8,684,353 | B2 * | 4/2014 | Miyazawa | B65H 7/02 271/250 |
| 8,789,828 | B2 * | 7/2014 | Wang | G07D 11/0027 271/251 |
| 2004/0239027 | A1 * | 12/2004 | Trovinger | B65H 7/08 271/227 |
| 2010/0164164 | A1 * | 7/2010 | Kondo | B65H 9/002 271/3.24 |
| 2013/0082441 | A1 * | 4/2013 | Banal | B65H 9/103 271/252 |

* cited by examiner

*Primary Examiner* — Jeremy R Severson
(74) *Attorney, Agent, or Firm* — Schwegman, Lundberg & Woessner

(57) ABSTRACT

Systems and methods for deskewing a media object may include receiving, at a deskew of a self-service terminal, the media object. The method may also include engaging a drive member to position the media object into a first position within the deskew. A deskew member may be engaged in a first direction to position the media object into a second position within the deskew. The deskew member may be engaged in a second direction to position the media object into a third position within the deskew.

20 Claims, 8 Drawing Sheets

MEDIA DESKEW

BACKGROUND

Self-service terminals have become ubiquitous within the retail and banking environments. At the retail level, self-service terminals reduce labor requirements and increase check-out efficiency by allowing one cashier to oversee many check-out lanes. Within the financial services sector, self-service terminals, or automated teller machines, allow banking and other financial customers to make withdrawals and deposits or perform other financial transactions without having to find time to visit a financial institution during banker's hours or even visit a financial institution.

SUMMARY

Systems and methods for deskewing a media object may include receiving, at a deskew, the media object. The method may also include engaging a drive member to position the media object into a first position within the deskew. A deskew member may be engaged in a first direction to position the media object into a second position within the deskew. The deskew member may be engaged in a second direction to position the media object into a third position within the deskew. The deskew may be located in a media handling module, such as a media depository, of a self-service terminal.

BRIEF DESCRIPTION OF THE FIGURES

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention any manner.

DETAILED DESCRIPTION

Figure 1:
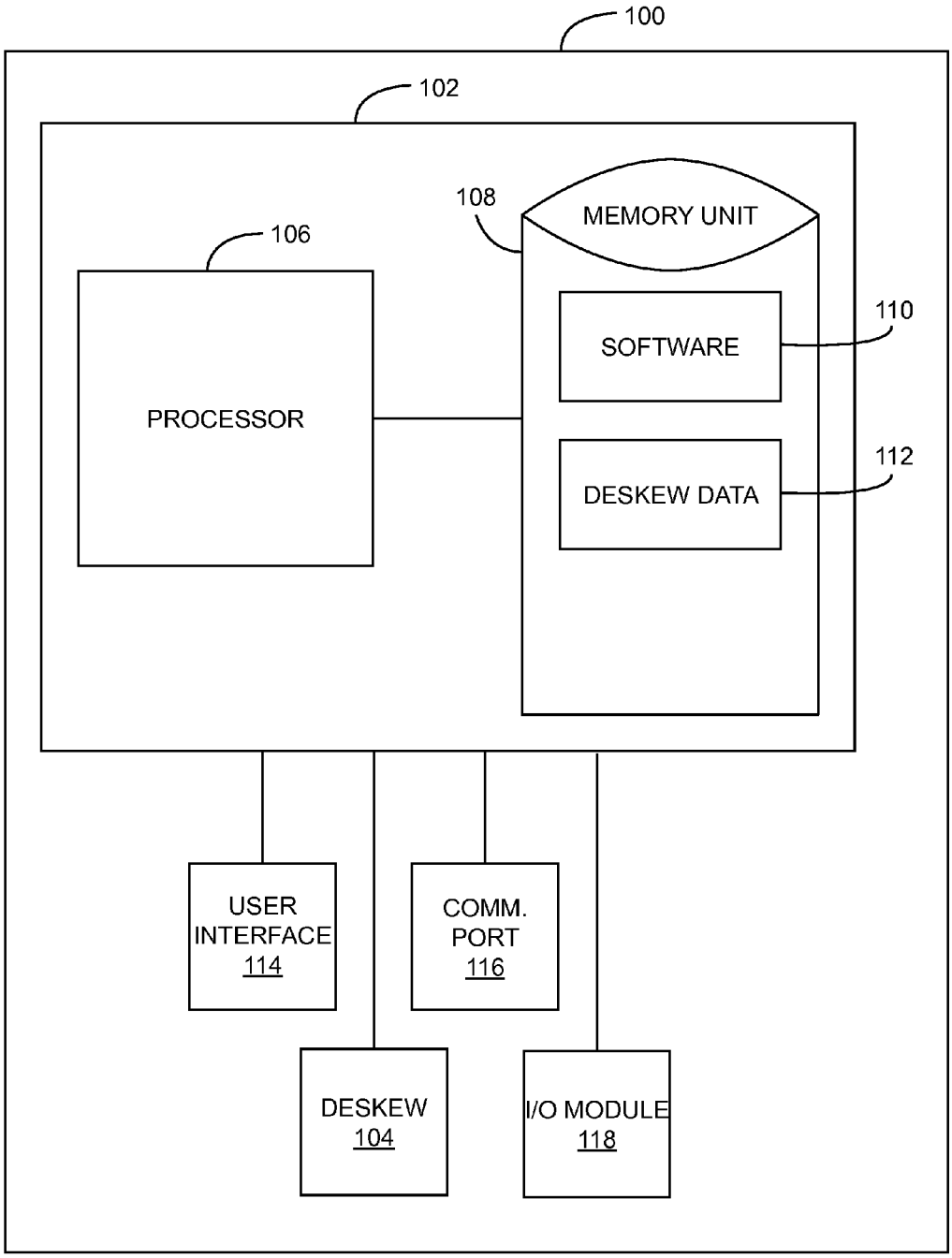
FIG. 1 shows an example schematic of a self-service terminal consistent with the disclosure.

The following detailed description refers to the accompanying drawings. Wherever possible, the same reference numbers are used in the drawings and the following description to refer to the same or similar elements. While embodiments and examples are described, modifications, adaptations, and other implementations are possible. For example, substitutions, additions, or modifications may be made to the elements and stages illustrated in the drawings, and the systems and methods described herein may be modified by substituting, reordering, or adding stages to the disclosed methods or elements to the disclosed systems. Accordingly, the following detailed description does not limit the disclosure. Instead, the proper scope of any invention disclosed herein is defined by the appended claims.

Self-service terminals can accept media objects of different sizes and conditions. In addition, the orientation of the media objects upon insertion into the self-service terminals can be inconsistent. To position the media objects into a uniform orientation, self-service terminals can use a deskew.

The deskew may include a drive member that can position a media object, such as a cheque or currency note, into a first position within the deskew. Once the media object is in the first position the deskew member can be used to position the media object into a second position. The second position can include an edge of the media object pressing against a fixed track of the deskew.

Movement of the media object along the fixed track may cause jams. The jams may be caused by tears in the media object or bunching of the media object. The media object may bunch due to older or more worn media objects being less stiff than newer or less worn media objects. In addition, transitions from one section of track to another can cause binding and other conditions that can lead to a jam. The binding and jams can also damage the media object. For example, during a transition from one track section to another, the media object may bind and tear.

To avoid jams, binding, and possible damage to the media object that can be caused by the media object moving along the fixed track, the deskew member can be reversed to reposition the now oriented media object a distance from the fixed track. Movement of the media object can be accomplished by reversing a motor that operates the deskew member. For example, a stepper motor can be reversed a fixed number of steps in order to move the media object a fixed distance from the fixed track.

FIG. 1 shows an example schematic of a self-service terminal 100 consistent with embodiments disclosed herein. The self-service terminal 100 may include a deskew 104 and a computing device 102. The deskew 104 may act as a media accepter/dispenser. During operation, the deskew 104 may accept media such as cheques and currency notes. As discussed herein, the deskew 104 may operate in conjunction with the computing device 102 to accept media and properly orient the media.

As shown in FIG. 1, the computing device 102 may include a processor 106 and a memory unit 108. The memory unit 108 may include a software module 110 and deskew data 112. While executing on the processor 106, the software module 110 and the deskew data 112 may perform processes for deskewing a media object, including, for example, one or more stages included in method 700 described below with respect to FIG. 7.

The self-service terminal 100 may also include a user interface 114. The user interface 114 can include any number of devices that allow a user to interface with the self-service terminal 100. Non-limiting examples of the user interface 114 can include a keypad, a microphone, a speaker, a display (touchscreen or otherwise), etc.

The self-service terminal 100 may also include a communications port 116. The communications port 116 may allow the self-service terminal 100 to communicate with information systems such as banking and other financial systems. Non-limiting examples of the communications port 116 can include, Ethernet cards (wireless or wired), Bluetooth® transmitters and receivers, near-field communications modules, etc.

The self-service terminal may also include an input/output (I/O) device 118. The I/O device 118 may allow the self-service terminal 100 to receive and output information. Non-limiting examples of the I/O device 118 can include, a camera (still or video), a printer, a scanner, etc.

Figure 2:
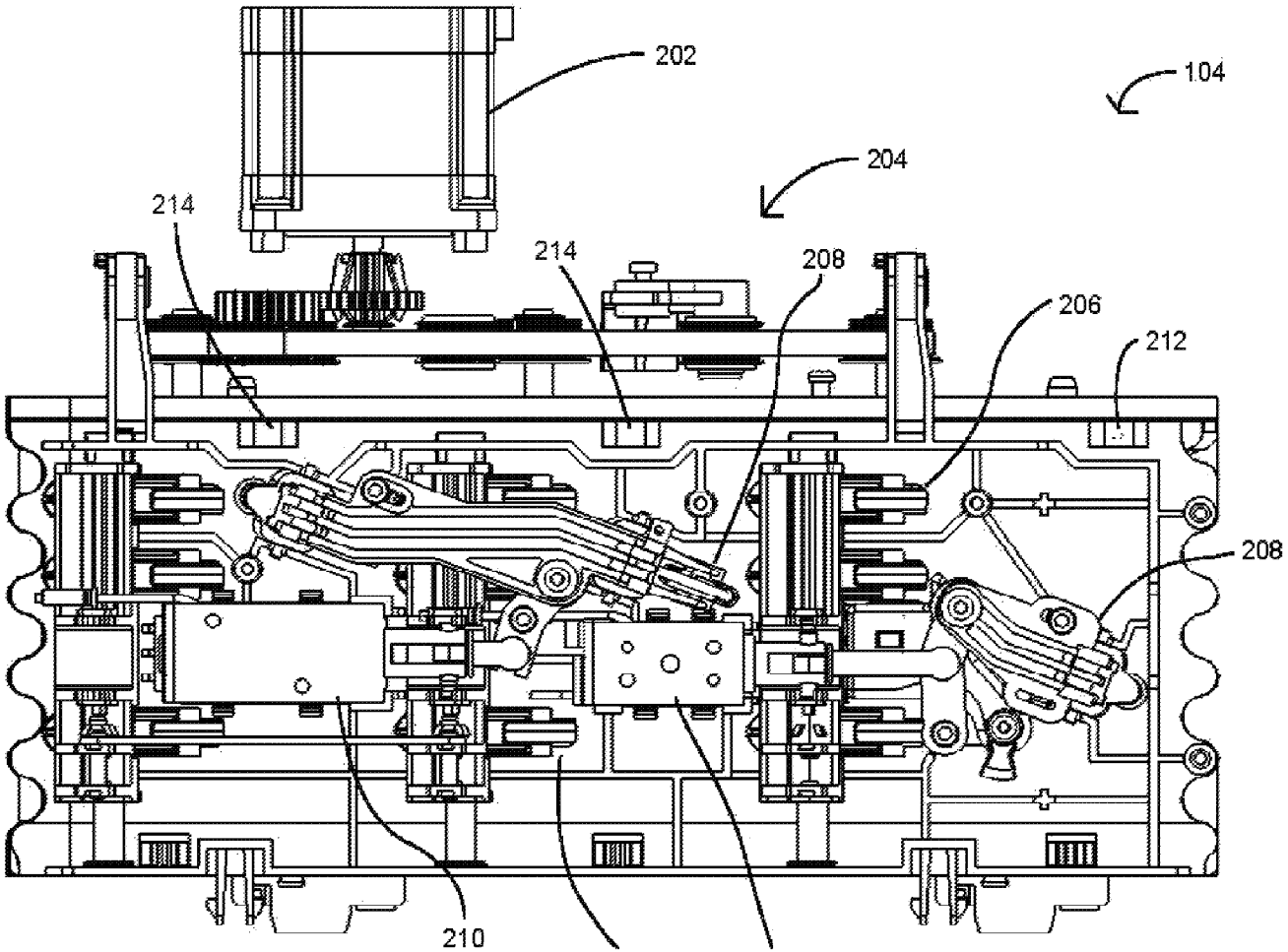
FIG. 2 shows an example top view of a deskew consistent with the disclosure.
Figure 3:
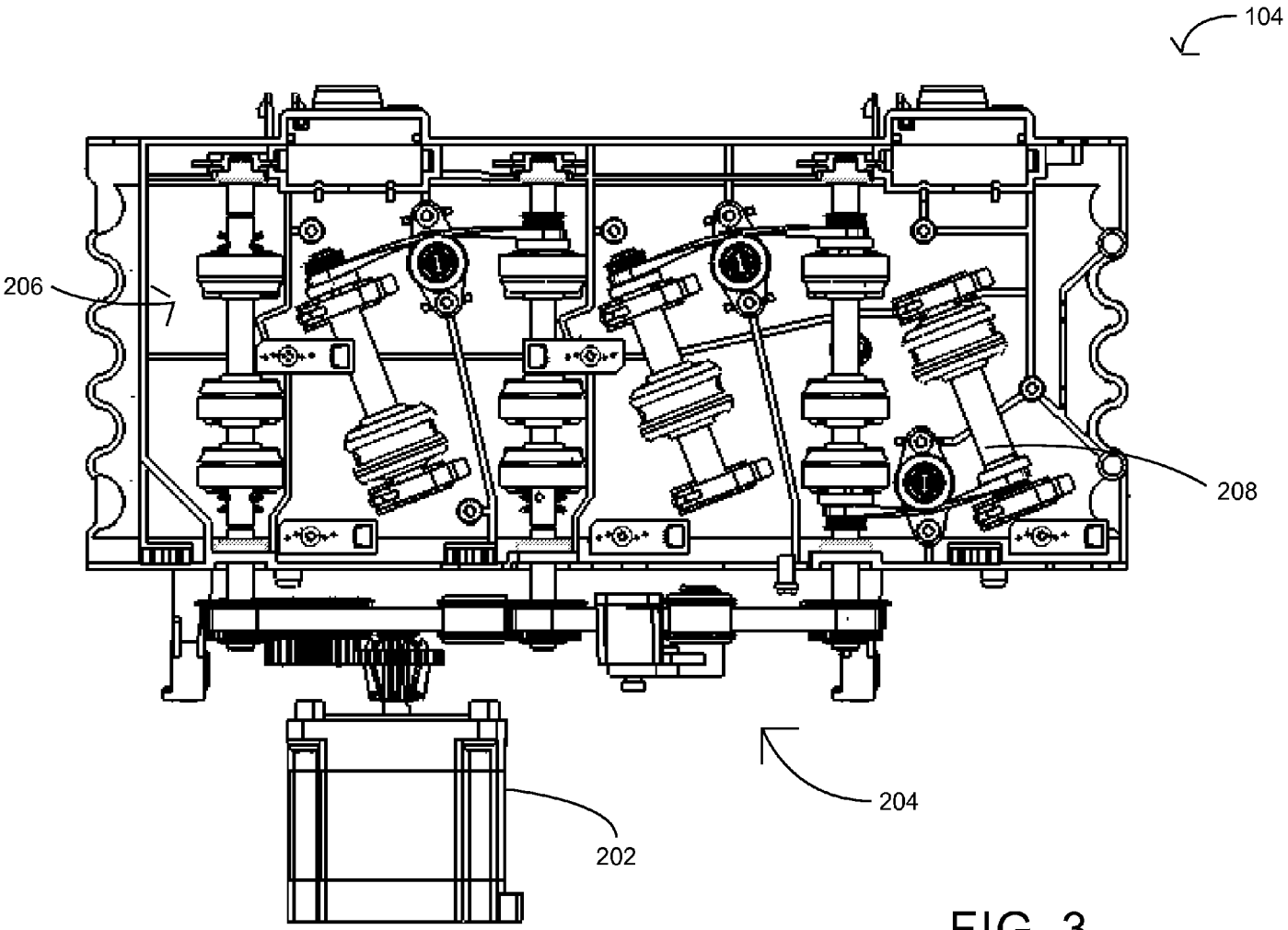
FIG. 3 shows an example bottom view of a deskew consistent with the disclosure.

FIGS. 2 and 3 show an example top view and a bottom view of the deskew 104. The deskew 104 can include a motor 202 operably connected to a drivetrain 204. The drivetrain 204 may be operably connected to a drive member 206 and a deskew member 208. As discussed below with respect FIGS. 4A-4D, the drive member 206 and the deskew member 208 may be used to position a media object within the deskew 104. The deskew member 208 and the drive member 206 can include one or more rollers, belts, or other forms of conveyance that can be used to move media through the deskew 104.

During operations, solenoids 210 and 212 may be used to raise and lower the drive member 206 and the deskew member 208. For example, to move the media object in a first direction, the solenoid 210 may lower the drive member 206 such that the drive member 206 contact a portion of the media object. To move the media object in a second direction the solenoid 210 may raise the drive member 206 and the solenoid 212 may lower the deskew member 208. A plurality of sensors 214 may be used to detect a position of the media object within the deskew 104. The plurality of sensors 214 may also be used to trigger operations such as engaging the drive member 206 and the deskew member 208 upon the media object being in given positions within the deskew 104.

Figure 4A:
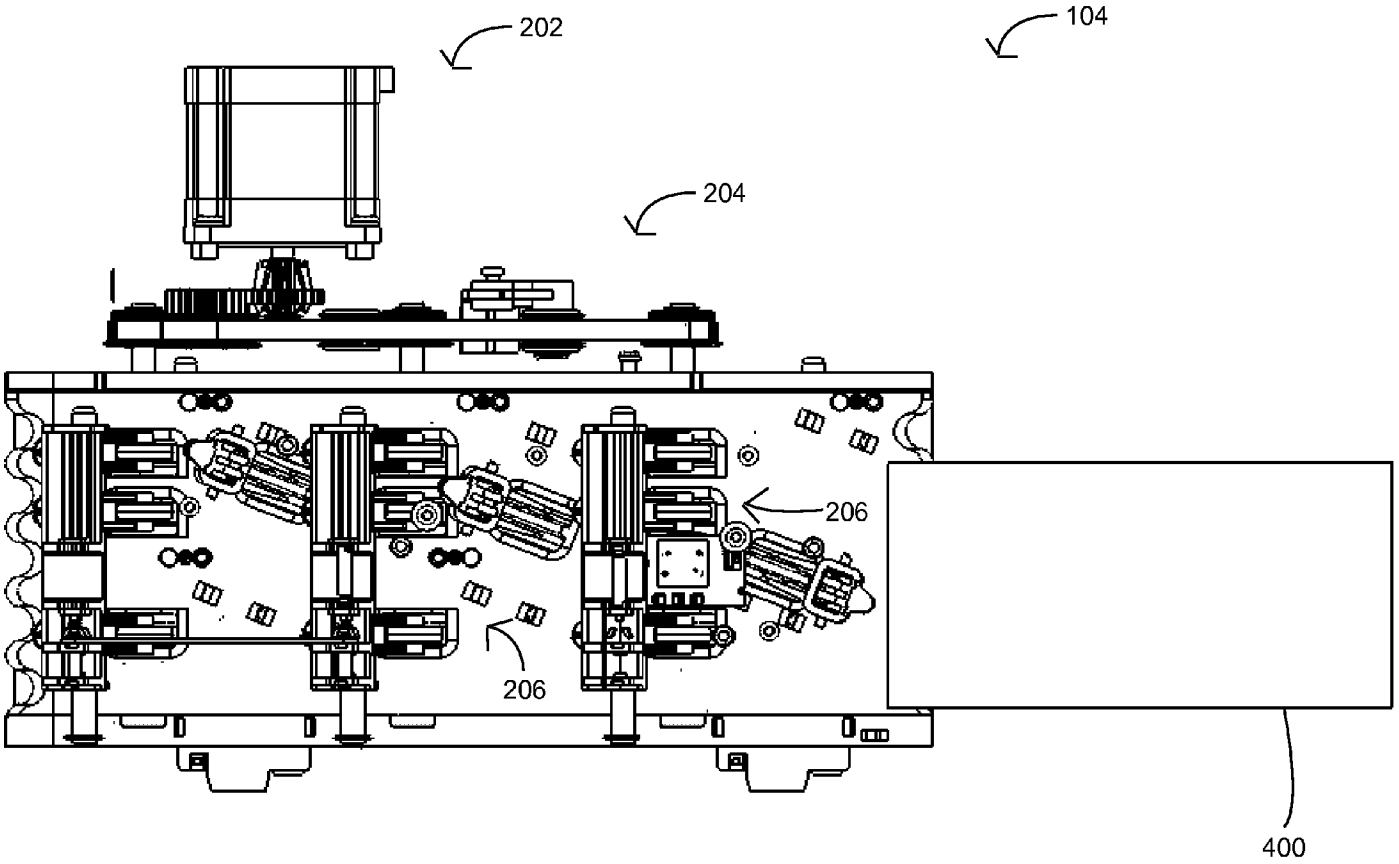
FIGS. 4A-4D show example stages for deskewing a media object consistent with the disclosure.

FIGS. 4A-4D show example stages for deskewing a media object 400 consistent with embodiments disclosed herein. As shown in FIG. 4A, the media object 400 may enter a first portion of the deskew 104. The media object 400 may be inserted into the self-service terminal 100 and may pass into the deskew 104. Upon the media object 400 entering the deskew 104, the motor 202 may be engaged. For example, upon the media object 400 entering the deskew 104, the computing device 102 may transmit a signal to the motor 202 and engage the drive member 206. The drive member 206 may cause the media object 400 to advance into the deskew 104 to a first position.

Figure 4B:
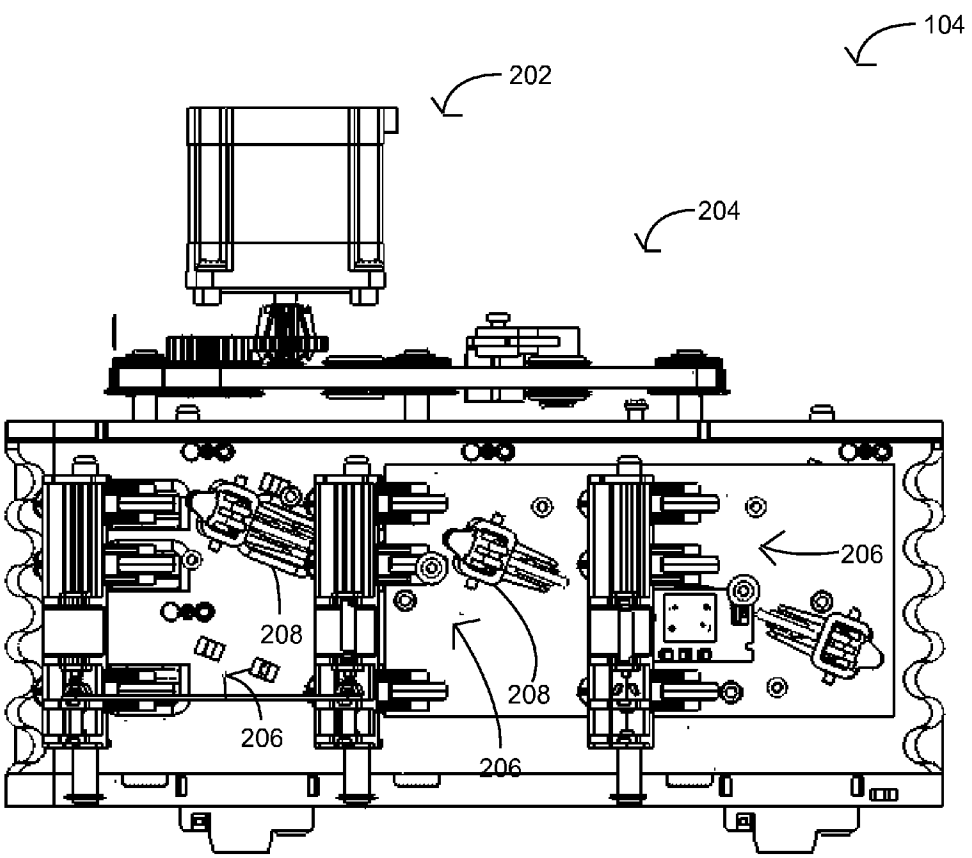

As shown in FIG. 4B, upon the media object 400 reaching a first position within the deskew 104, the computing device 102 may receive signals from the plurality of sensors 214. Upon receiving the signals from the plurality of sensors 214, the computing device 102 may transmit a signal to the solenoids 210 and 212. The signal may cause the solenoids 210 and 212 to raise the drive member 206 and lower the deskew member 208.

Figure 4C:
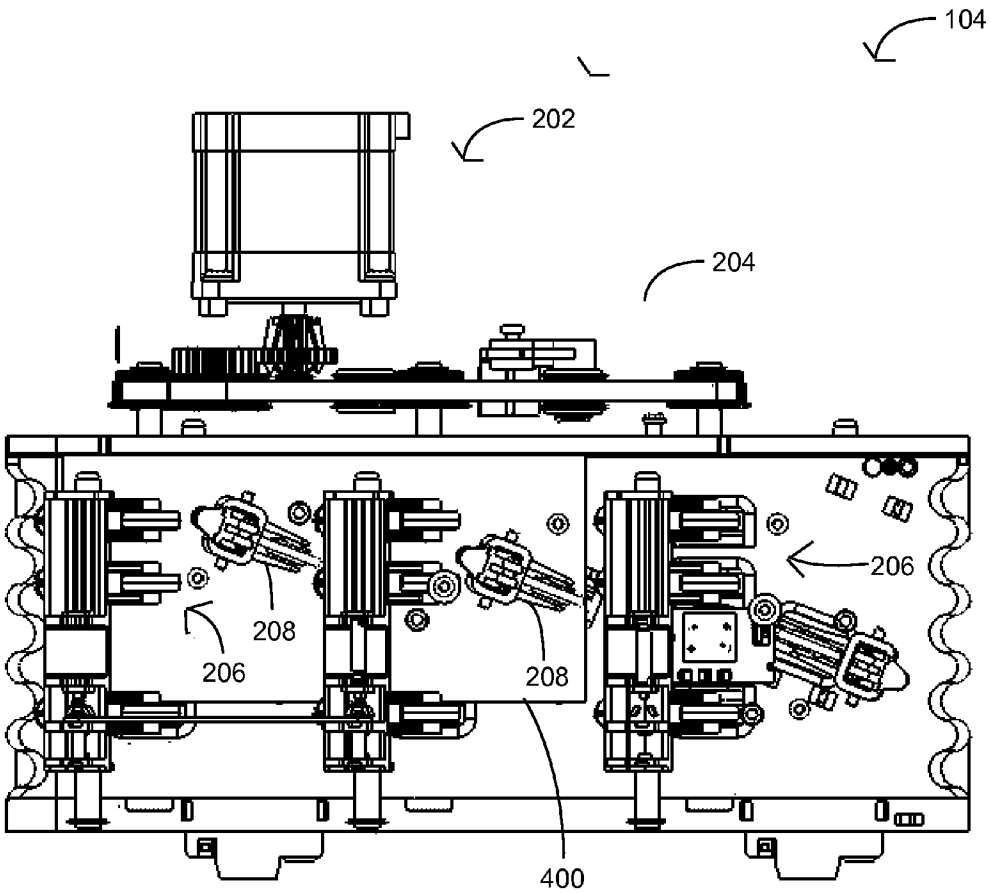
Figure 5:
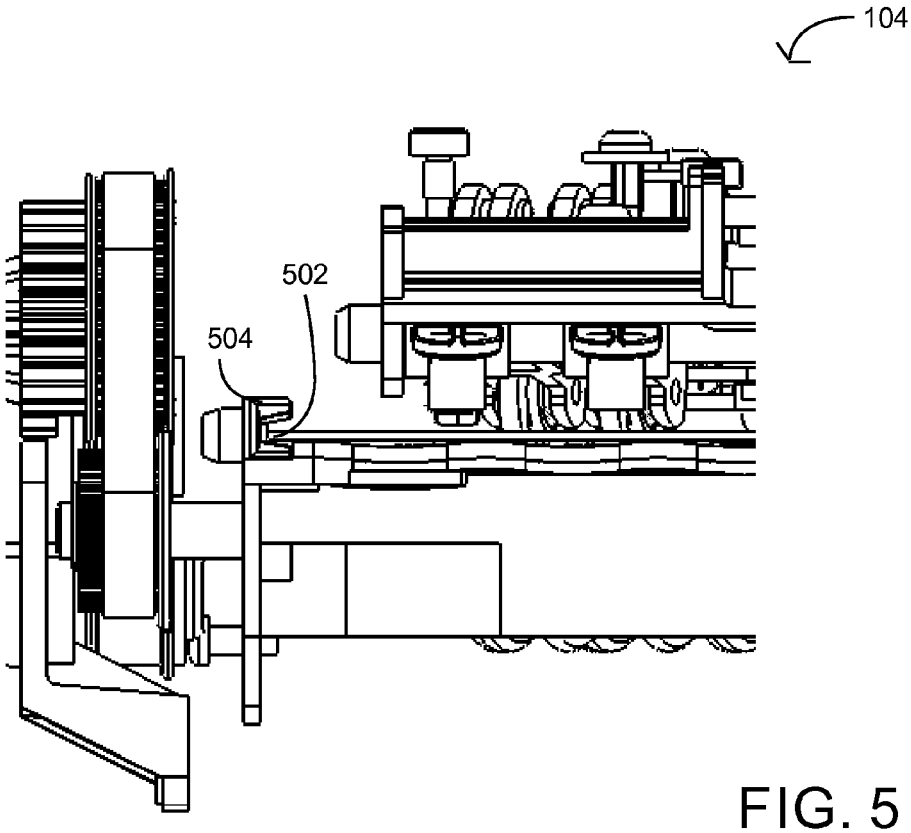
FIG. 5 shows a media object in a first position consistent with the disclosure.

As shown in FIG. 4C, the lowering of the deskew member 208 may cause the media object to transition into a second position. As shown in FIG. 5, the second position may include an edge 502 of the media object 400 resting against a track 504. The plurality of sensors 214 may detect when the media object 400 reaches the second position. The media object 400 in the second position may also be detected by feedback from the motor 202. For example, a strain placed on the motor 202 as the edge 502 of the media object 400 contacting the track 504 may be used to determine that the media object 400 is in the second position. For instance, a current draw increase by the motor 202 may indicate a strain placed on the motor 202 and thus, that the medial object 400 is in the second position.

Figure 6:
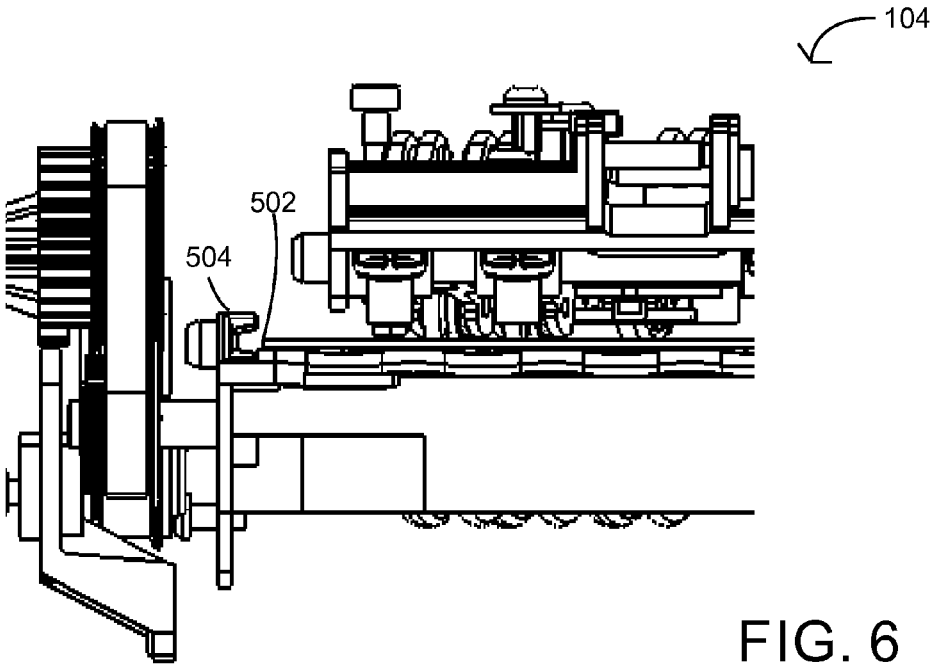
FIG. 6 shows a media object in a second position consistent with the disclosure.

Upon the media object 400 reaching the second position, the computing device 102 may transmit a signal to the motor 202. The signal may cause the motor 202 to reverse direction. Reversing the direction of the motor 202, the media object 400 may be moved a distance from the track 504 as shown in FIG. 6. In addition, a distance from the track 504, the media object 400 may be repositioned such that the edge 502 may parallel to a central axis of the deskew 104.

To reposition the media object 400 the motor 202 may be reversed for a preset time, such as for example, 0.05 seconds. In addition, the motor 202 may be a stepper motor and the stepper motor may be reversed for a preset number of steps, such as for example, 5 steps. In addition, to reposition the media object 400 additional solenoids and gears (not shown) may be used to reverse the direction of the deskew member 208 without reversing the direction of the motor 202.

Figure 4D:
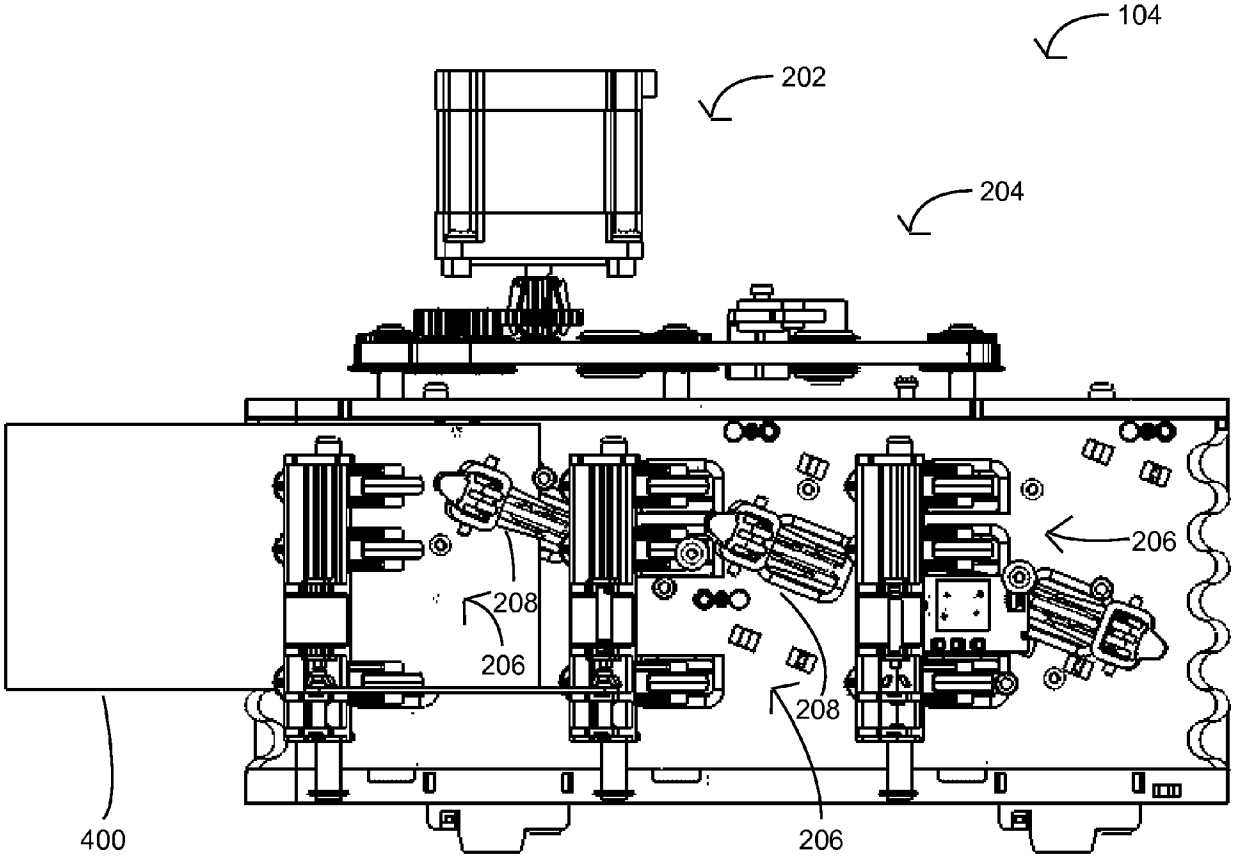

As shown in FIG. 4D, upon the media object being reposition, a signal can be transmitted from the computing device 102 to the solenoids 210 and 212 to raise the deskew member 208 and lower the drive member 206. Upon lowering the drive member 206, the media object 400 can be ejected from the deskew 104.

It will be readily understood to those skilled in the art that various other changes in the details, material, and arrangements of the parts and method stages which have been described and illustrated in order to explain the nature of the inventive subject matter may be made without departing from the principles and scope of the inventive subject matter as expressed in the subjoined claims.

What is claimed is:

1. A method of deskewing media, the method comprising:
- receiving, at a deskew of a self-service terminal, a media object;
- engaging a drive member to position the media object into a first position within the deskew;
- engaging a deskew member in a first direction to position the media object into a second position within the deskew, wherein the second position is determined by a strain placed on a motor of the deskew member; and
- engaging the deskew member in a second direction opposite the first direction to position the media object into a third position behind the second position within the deskew.

2. The method of claim 1, wherein the second position includes an edge of the media object in contact with a track.

3. The method of claim 1, wherein the third position includes an edge of the media object proximate a track.

4. The method of claim 1, wherein the third position includes an edge of the media object parallel with a central axis of the deskew.

5. The method of claim 1, wherein engaging the deskew member in the second direction includes reversing a direction of rotation of the deskew member for a preset time.

6. The method of claim 1, wherein the motor is a stepper motor and wherein engaging the deskew member in the second direction includes reversing a direction of rotation of the stepper motor for a preset number of steps.

7. The method of claim 1, further comprising ejecting the media object from the deskew.

8. A system comprising:
- a processor; and
- a memory storing instructions that, by the processor, cause the processor to perform operations comprising:
  - engaging a motor, the motor coupled to a drive member,
  - receiving, from a sensor, a signal indicating a media object is located in a first position,
  - engaging the motor, the motor coupled to a deskew member to position the media object in a second position, wherein the second position is determined by a strain placed on the motor, and engaging the motor coupled to the deskew member in an opposite direction to position the media object in a third position behind the second position.

9. The system of claim 8, wherein the second position includes an edge of the media object in contact with a track.

10. The system of claim 8, wherein the third position includes an edge of the media object proximate a track.

11. The system of claim 8, wherein the third position includes an edge of the media parallel with a central axis of a deskew.

12. The system of claim 8, wherein engaging the motor in the opposite direction to position the media object in the third position includes reversing a direction of rotation of the deskew member for the preset time.

13. The system of claim 8, wherein the motor is a stepper motor and wherein engaging the motor in the opposite direction to position the media object in the third position includes reversing a direction of rotation the stepper motor for a preset number of steps.

14. The system of claim 8, wherein the operations further comprise engaging the motor coupled to the drive member to eject the media object from the deskew.

15. A media depository comprising:

a motor;

a drive member operably coupled to the motor, the drive member further operable to move a media object into a first position; and a deskew member operably coupled to the motor and operable to move the media object the first position into a second position and from the second position into a third position behind the second position, and determine the media object is in the second position by detecting a strain placed on the motor.

16. The media depository of claim 15, further comprising a track, wherein the second position includes an edge of the media object in contact with the track.

17. The media of claim 15, further comprising a track, wherein the third position includes an edge of the media object proximate the track.

18. The media depository of claim 15, wherein the third position includes an edge of the media object parallel with a central axis of the media depository.

19. The media depository of claim 15, wherein the motor is a stepper motor and the deskew member operable to move the media object from the first position into the second position and from the second position into the third position includes the stepper motor operable to reversing a direction of rotation for a preset number of steps.

20. The media de of claim 15, further comprising a plurality of sensors operable to detect a position of the media object within the media depository.

* * * * *